US006802873B1

(12) United States Patent
Bartl et al.

(10) Patent No.: US 6,802,873 B1
(45) Date of Patent: Oct. 12, 2004

(54) METHOD FOR PRODUCING DYED TEXTILE MATERIALS CONSISTING OF POLYESTER AND POLYAMIDE

(75) Inventors: Heike Bartl, Weinheim (DE); Kurt Jörder, Weinheim (DE)

(73) Assignee: Carl Freudenberg KG, Weinheim (DE)

( * ) Notice: Subject to any disclaimer, the term of this patent is extended or adjusted under 35 U.S.C. 154(b) by 99 days.

(21) Appl. No.: 10/130,652

(22) PCT Filed: Oct. 6, 2000

(86) PCT No.: PCT/EP00/09804

§ 371 (c)(1),
(2), (4) Date: Jul. 31, 2002

(87) PCT Pub. No.: WO01/38628

PCT Pub. Date: May 31, 2001

(30) Foreign Application Priority Data

Nov. 25, 1999 (DE) ..... 199 56 780

(51) Int. Cl.[7] ..... D06P 8/32

(52) U.S. Cl. ..... 8/529; 8/531; 8/533; 8/640; 8/650; 8/653

(58) Field of Search ..... 8/529, 531, 533, 8/640, 650, 653

(56) References Cited

U.S. PATENT DOCUMENTS 3,493,316 A 2/1970 Ortheil et al.

OTHER PUBLICATIONS

Database WPI Section Ch. Week 199620, Derwent Publications Ltd. London. GB. AN 1996–199056, XP002163569. Abstract of KR9407030 Aug. 1994.
Database WPI Section Ch. Week 199551, Derwent Publications Ltd. London. GB. AN 1995–401691. XP002163568. Abstract of JP7279064 Oct. 1995.

*Primary Examiner*—Margaret Einsmann
(74) *Attorney, Agent, or Firm*—Kenyon & Kenyon

(57) ABSTRACT

The invention relates to a method for producing dyed textile materials consisting of polyester and polyamide. The textile material is dyed by means of pigments or a disperse dye that stains polyester. Surplus dye is removed. The polyamide portion is dyed using vat dyes, leuco vat dyes, sulphide dyes or soluble sulphide dyes. Said dyes are vatted if this is required for obtaining a solubility and are oxidatively converted into the real dyes after attaching.

19 Claims, No Drawings

METHOD FOR PRODUCING DYED TEXTILE MATERIALS CONSISTING OF POLYESTER AND POLYAMIDE

BACKGROUND OF THE INVENTION

The present invention relates to a method for producing dyed textile materials made of polyester and polyamide.

Dyeing methods for polyester and polyamide fibers are known from the literature (see Ullmann's Encyclopaedia of Industrial Chemistry, 6th Edition, 1998). There, disperse dyestuffs are preferably suggested for dyeing polyester fibers, and acid dyestuffs for dyeing polyamide fibers.

In addition, several dyeing methods are known from the literature for polyester/polyamide microfiber mixtures (brochure of the firm Sandoz Chemical AG).

In that case, dyeing a) should be performed using only disperse dyestuffs, having the disadvantage that, beginning at a certain depth of color, two color effects appear;
b) using two classes of dyestuff is performed, and bicolor effects are consciously accepted;
c) is two-bath, whereby, to be sure, color fastness can be improved, but costs go up at the same time, and
d) is single-bath, whereby, however, available color combinations are severely limited.

Especially for medium and deep color tones, color fastness is achieved only up to 40° C.

For the present invention, the object was set to describe a method which permits the production of dyed textile materials, made of polyester and polyamide, and permits a wash resistance for medium and deep color shades up to at least 60° C.

According to the present invention the object is attained in that the textile material is dyed with disperse dyestuffs which dye polyester or with pigments, excess dyestuff is removed, and dyeing the polyamide portion is undertaken with the aid of vat dyestuff, leuco vat dyestuffs, sulfide dyestuffs or soluble sulfide dyestuffs, and in case it is necessary to achieve their solubility, the above-named dyestuffs being vatted, and, after dye take-up, being oxidatively converted to the fast dyestuff. In this manner wash resistance up to at least 60° C. is achieved, even for medium and deep color shades. On top of that, no special aftertreatment is necessary to achieve such colorfastness, and thereby savings are achieved with respect to chemicals and the water necessary for carrying out the method.

Dyeing the polyamide portion is preferably undertaken using vat dyestuffs. Vat dyestuffs have proven to be the most stable with respect to their fastness to light and wetness (resistance to washing, water and perspiration).

One method is particularly preferred in which one first dyes the polyester portion with disperse dyestuffs, subsequently carries out a reductive cleaning at ca 80° C., and then dyes the polyamide portion. This advantageous variant of the method leads to greater wetfastness of the dyed materials.

A further preferred variant of the method is to conduct the dyeing in a dye bath, the removal of the excess disperse dyestuffs dyeing the polyester and/or split microfiber spunbond nonwovens being carried out simultaneously with the vatting, using reduction media such as sodium dithionite, glucose or sodium sulfide. Dyeing in only one dyeing bath improves dyeing economy, since fewer chemicals, less water and only one installation are required.

Nonwoven fabrics are preferably used as the textile materials in the method. These pricewise very reasonable materials can be improved in this manner by dyeing technology.

Advantageously, split microstaple fiber or spunbonded nonwoven fabrics are used as the textile materials. Surprisingly, the known difficulties in dyeing these microfiber nonwoven fabrics were able to be overcome.

Microfilament nonwoven fabrics made of spun-dyed polyester and/or polyamides are particularly preferred. In the case of these microfilament nonwoven fabrics, both lightfastness and wetfastness are further increased.

In the following, the present invention is explained in greater detail as given in five exemplary dyeing methods. As a comparison, dyeing using disperse dyestuff and subsequent dyeing using an acid dyestuff is carried out in the same manner with three color shades. The results of the evaluation of colorfastness are assembled in Table 2.

EXAMPLE 1

A microfilament nonwoven fabric, made of 35% by weight of polyamide and 65% by weight of polyester, is dyed in a two-step exhaust method using disperse dyestuffs, such as Dispersol®, and vat dyestuffs, such as Indanthrene®. For this, in a first bath, the Dispersol dyestuffs named in Table 1 are suspended with 1 g/l of a dispersing agent Setamol® WS, 0.5 g of a complexing agent, such as Trilon® TA powder. The pH value of the dispersion is standardized to pH 4.5 to 5, using acetic acid. The dyebath ratio is 1:10. Dyeing takes place for 45 minutes at 130° C. Subsequently reductive cleaning is carried out using sodium dithionite. In a second dyebath dyeing is carried out using the vat dyestuffs also mentioned in Table 1. The dyestuff is here dispersed together with 2 ml/l of a protective colloid, such as Dekol® SN, and 0.5 g/l of a complexing agent, such as Trilon® TA, and is vatted with 2 ml/l of sodium hydroxide solution 38° Bé and 2.0 g/l sodium dithionite. Dyeing takes place at 80° C. for 30 min. Subsequently, cooling to 60° C. is performed, and oxidizing for a further 10 min at 60° C. For this oxidation of the vat dyestuff to the fast dyestuff, a 50% solution of hydrogen peroxide or a nitrobenzolsulfonic acid-salt solution is used. Excess dye is rinsed out by washing with water.

EXAMPLE 2

A microfilament nonwoven fabric according to Example 1 is dyed in a single-vessel method by a mixture of the disperse dyestuffs and vat dyestuffs stated in Table 1. In this connection, both the disperse dyestuff and the vat dyestuff are dispersed together with 1 g/l dispersing agent (Setamol® WS), 0.5 g/l of a complexing agent (Trilon® powder) and 2 ml/l of a protective colloid (Dekol® SN), and is standardized to a pH value 4.5 to 5 using acetic acid. The dyebath ratio is 1:10. Dyeing takes place at 130° C. for 45 minutes. Cooling to 80° C. then takes place, 2 ml sodium hydroxide solution per liter of dyebath 38° Bé, 2.0 g/l sodium dithionite and 25 g/l Glauber salt are added and reductive cleaning as well as vatting are carried out for 30 min at 80° C. Subsequently, cooling to 60° C. is performed, and oxidizing for a further 10 min at 60° C. The dyed microfilament nonwoven fabric is rinsed with water to remove the excess dyestuff.

EXAMPLE 3

A microfilament nonwoven fabric according to Example 1 is dyed in two-step exhaust dyeing by vat dyestuffs, such as Indanthrene® and in a subsequent disperse dyestuff dyeing using a dye such as Dispersol®. The combined disperse dyestuffs and vat dyestuffs are given in Table 1. The dyebaths are composed analogously to Example 1, a difference being that dyeing by the vat dyestuff is undertaken first.

EXAMPLE 4

A microfilament nonwoven fabric according to Example 1 is dyed in a pad dyeing method as in the Thermosol pad-steam process using disperse and vat dyestuffs. The composition of the pad dyeing bath corresponds to the dyebath composition as in Example 2. The dyestuff is padded at 100° C., dried for 2 min and fixed for 60 sec at 215° C. In order to develop the vat dyestuff, 2 ml/l sodium hydroxide solution 38° Bé and 2 g/l of a reducing agent, namely sodium dithionite (Hydrosulfite konz®) are padded. Finally, subduing is performed for 60 sec at 102° C., and rinsing with water after oxidation.

EXAMPLE 5

A microfilament nonwoven fabric is printed in a printing method using pigment (70 g/l Acramin navy FBC®) and leuco vat dyestuff (30 g/l Antrasol blue IBC®). The pigment and the leuco vat dyestuff are added to a binder system composed of water, 9.0 g/l of an antifoaming agent (Respumit® 3300), 9.0 g/l of an emulsifier (Emulgator® VA02), 110.0 g/l of a binding agent (Acramin® CLW), 30.0 g/l of a thickening agent (Acraconz® BN) and 9.0 g/l of a melamine resin cross-linking agent (Cassurit® HML) and stirred to a printing paste. The printing paste is applied to the nonwoven fabric via a printing screen. After that, drying is done for 1 min at 130° C., and the pigment is fixed for 1 min at 160° C.

To fix the leuco vat dyestuff, subduing is performed for 60 sec at 102° C. After the oxidation the excess dyestuff is removed by rinsing with water.

Fastnesses were ascertained, and proved to be numerically identical to those shown in Table 2, Example 4 ("navy").

TABLE 1

| | Color: | | |
|---|---|---|---|
| Example: | Red | Dark Brown | Navy |
| 1 | 3.75% Dispersol Deep Red SF<br>0.15% Dispersol Navy XF<br>3.00% Indanthrene Red FBB Coll.<br>0.15% Indanthrene Blue CLF Coll. | 0.60% Dispersol Deep Red SF<br>4.50% Dispersol Yellowish Brown XF<br>1.80% Dispersol Navy XF<br>0.51% Indanthrene Red FBB Coll.<br>3.60% Indanthrene Brown LBG Coll.<br>0.30% Indanthrene Blue CLF Coll. | 0.48% Dispersol Deep Red SF<br>2.40% Dispersol Yellowish Brown XF<br>6.60% Dispersol Navy XF<br>0.64% Indanthrene Brown LBG Coll.<br>1.60% Indanthrene Dark Blue DB Coll. |
| 2 | 3.75% Dispersol Deep Red SF<br>0.15% Dispersol Navy XF<br>3.00% Indanthrene Red FBB Coll.<br>0.15% Indanthrene Blue CLF Coll. | 0.60% Dispersol Deep Red SF<br>4.50% Dispersol Yellowish Brown XF<br>1.80% Dispersol Navy XF<br>0.51% Indanthrene Red FBB Coll.<br>3.60% Indanthrene Brown LBG Coll.<br>0.30% Indanthrene Blue CLF Coll. | 0.48% Dispersol Deep Red SF<br>2.40% Dispersol Yellowish Brown XF<br>6.60% Dispersol Navy XF<br>0.64% Indanthrene Brown LBG Coll.<br>1.60% Indanthrene Dark Blue DB Coll. |
| 3 | 3.75% Dispersol Deep Red SF<br>0.15% Dispersol Navy XF<br>3.00% Indanthrene Red FBB Coll.<br>0.15% Indanthrene Blue CLF Coll. | | |
| 4/5 | 37.5 g/l Dispersol Deep Red SF<br>1.50 g/l Dispersol Navy XF<br>30.0 g/l Indanthrene Red FBB Coll.<br>1.50 g/l Indanthrene Blue CLF Coll. | 6.00 g/l Dispersol Deep Red SF<br>45.0 g/l Dispersol Yellowish Brown XF<br>18.0 g/l Dispersol Navy XF<br>5.00 g/l Indanthrene Red FBB Coll.<br>36.0 g/l Indanthrene Brown LBG Coll.<br>3.00 g/l Indanthrene Blue CLF Coll. | 6.00 g/l Dispersol Deep Red SF<br>30.0 g/l Dispersol Yellowish Brown XF<br>99.0 g/l Dispersol Navy XF<br>8.00 g/l Indanthrene Brown LBG Coll.<br>20.0 g/l Indanthrene Dark Blue DB Coll. |

TABLE 2

| | Example 1 Exhaust Dyeing Method (2-Step) 1. Dispersol ® (Dispersion) Reductive Cleaning 2. Indanthrene ® (VAT) | | | Example 2 Exhaust Dyeing Method (1-Step) Dispersol ® (Dispersion + Indanthrene ® (VAT) | | | Example 3 Exhaust Dyeing Method (2-Step) 1. Indanthrene ® (VAT) 2. Dispersol ® (Dispersion) Reductive Cleaning | Example 4 Thermosol Pad-Stream Process Dispersol ® (Dispersion) + Indanthrene (VAT) | | | State of the Art (2-Step) 1. Dispersion Dye (e.g. Dianix ® HF) Reductive Cleaning 2. Acid or Metallic Complex Dyestuff (e.g. Telon ®, Isolan ®, Supranol ®) | | |
|---|---|---|---|---|---|---|---|---|---|---|---|---|---|
| | Red | Dark Brown | Navy | Red | Dark Brown | Navy | Red | Red | Dark Brown | Navy | Red | Dark Brown | Navy |
| Washfastness 40° C. EN ISO 105 C06-A2S | 4–5S<br>4–5C | 4–5S<br>4–5C | 4–5S<br>4–5C | 4–5S<br>4–5C | 4S<br>4–5C | 4–5S<br>4–5C | 4–5S<br>4–5C | 4–5S<br>4–5C | 4–5S<br>4C | 3–4S<br>4C | 3S<br>4C | 2–3S<br>2–3C | 3S<br>4C |
| Washfastness 60° C. EN ISO 105 C06-C2S | 4–5S<br>4–5C | 4S<br>4–5C | 4S<br>4–5C | 4–5S<br>4–5C | 3–4S<br>4–5C | 3–4S<br>4–5C | 4–5S<br>4C | 3–4S<br>4–5C | — | — | 1–2S<br>2–3C | 1–2S<br>2–3C | 1–2S<br>2–3C |
| Washfastness 95° C. EN ISO 105 C06-E2S | 3S<br>3–4C | 2S<br>3C | 1–2S<br>2–3C | 3S<br>3–4C | 1–2S<br>3C | 1–2S<br>3–4C | — | — | — | –<br>1–2C | 1S<br>3C | 1S<br>2C | 1S |
| Waterfastness EN ISO 105 E01 | 4–5S<br>4–5C | 4–5S<br>4–5C | 4–5S<br>4–5C | 4–5S<br>4–5C | 4–5S<br>4–5C | 4–5S<br>4–5C | 4S<br>4–5C | 4S<br>4–5C | 4–5S<br>4–5C | 4-S<br>4–5C | 2–3S<br>4–5C | 2–3S<br>2–3C | 2–3S<br>4C |
| Perspiration fastness EN ISO 105 E04 acid alkaline | 4–5S/4–5C<br>4S/4–5C | 4–5S/4–5C<br>4S/4–5C | 4–5S/4–5C<br>4S/4 . 5C | 4–5S/4–5C<br>4S/4–5C | 4–5S/4–5C<br>4S/4–5C | 4–5S/4–5C<br>4S/4–5C | 4S/4–5C<br>4S/4–5C | 4S/4–5C<br>4S/4–5C | 4–5S/4–5C<br>4S/4–5C | 4S/4–5C<br>3–4S/4–5C | 2–3S/4–5C<br>2–3S/4C | 2–3S/2–3C<br>2–3S/3C | 3S/4C<br>2–3S/4C |
| Rubfastness (Dry/Wet) EN ISO 105 × 12 | 4–5 dry<br>4 wet | 4–5 dry<br>4 wet | 4–5 dry<br>4 wet | 4–5 dry<br>4 wet | 4–5 dry<br>4 wet | 4–5 dry<br>4 wet | 4–5 dry<br>3–4 wet | 4–5 dry<br>4 wet | 4–5 dry<br>4 wet | 4–5 dry<br>3–4 wet | 4–5 dry<br>4 wet | 4–5 dry<br>4 wet | 4–5 dry<br>4 wet |
| Lightfastness EN ISO 105 B02 | 5 | 5 | 5–6 | 5 | 5 | 5–6 | 5 | 5 | 5 | 5–6 | 4–5 | 4–5 | 5 |

S = Bleeding/C = Color Change
5 = very good
// 1= very bad
Grading was done according to Grey Scale ISO 105-A02 and ISO 105-A03

What is claimed is:

1. A method for producing a dyed textile material made of polyester and polyamide, comprising the steps of:

providing a textile material comprising a polyester portion and a polyamide portion;

dyeing the textile material with disperse dye that dyes polyester or with a pigment;

removing any excess dye; and dyeing the polyamide portion using vat dye, leuco vat dye, sulphide dye or soluble sulphide dye;

wherein a washfastness of at least 3–4 is achieved at 60° C. when tested using ISO 105 C06-C2S; and wherein during dying of the polyester, the dye bath composition is standardized to a pH-value of 4.5 to 5.

2. The method as recited in claim 1, wherein the polyamide portion is dyed using vat dye, wherein after dye-take up the vat dye is oxidatively converted.

3. The method as recited in claim 1 comprising:

first dyeing the polyester portion using disperse dye followed by a reductive cleaning at approximately 80° C.; and then dyeing the polyamide portion.

4. The method as recited in claim 2, wherein the dyeing steps are performed in one dye bath, and the removing step is carried out simultaneously with vatting, using reducing agents selected from the group consisting of sodium dithionite, glucose and sodium sulfide.

5. The method as recited in claim 1, wherein the textile material is a nonwoven fabric.

6. The method as recited in claim 5, wherein the nonwoven fabric is a split micro-staple fiber nonwoven fabric or a micro-spunbonded nonwoven fabric.

7. The method as recited in claim 6, wherein the nonwoven fabric is a microfilament nonwoven fabric made of spun-dyed polyester and polyamides.

8. The method as recited in claim 6, wherein the nonwoven fabric is a microfilament nonwoven fabric made of spun-dyed polyester or polyamides.

9. A method for producing a dyed textile material made of polyester and polyamide, comprising the steps of:

providing a textile material comprising a polyester portion and a polyamide portion;

dyeing the polyester portion with disperse dye that dyes polyester;

followed by reductively cleaning the textile material at about 80° C.; and dyeing the polyamide portion using vat dye;

wherein a washfastness of at least 3–4 is achieved at 60° C. when tested using ISO 105 C06-C2S;

wherein during dying of the polyester, the dye bath composition is standardized to a pH-value of 4.5 to 5; and wherein the polyester portion dyeing step and the polyamide portion dyeing step are performed in different dye baths.

10. The method of claim 9 wherein the textile material is a microfilament nonwoven fabric, made of about 35% by weight of polyamide and about 65% by weight of polyester.

11. The method of claim 10 wherein the dyeing of the polyester portion takes place for about 45 minutes at about 130° C.

12. The method of claim 11 wherein the dyeing of the polyamide portion takes place for about 30 minutes at about 80° C.

13. The method of claim 12 wherein the reductively cleaning is carried out using sodium dithionite.

14. The method of claim 13 further comprising, subsequently, cooling to about 60° C. and oxidizing for about 10 minutes further at about 60° C.

15. The method of claim 13 further comprising rinsing excess dye out by washing with water.

16. A method for producing a dyed textile material made of polyester and polyamide, comprising the steps of:

providing a textile material comprising a polyester portion and a polyamide portion;

dyeing the textile material in a dye bath comprising disperse dye and vat dye at about 130° C.;

cooling the textile material to about 80° C. followed by reductively cleaning and vatting at about 80° C.; and cooling and oxidizing the textile material at about 60° C., followed by rinsing to remove excess dye, wherein a washfastness of at least 3–4 is achieved at 60° C. when tested using ISO 105 C06-C2S; and wherein the dye bath is standardized to a pH-value of 4.5 to 5.

17. The method of claim 1 wherein the textile material is first dyed with the vat dye.

18. A method for producing a dyed textile material made of polyester and polyamide, comprising the steps of:

providing a textile material of a microfilament nonwoven fabric comprising a polyester portion and a polyamide portion;

providing a printing paste comprising a pigment and a leuco vat dye; and applying the printing paste to the nonwoven fabric using a printing screen.

19. The method of claim 18 further comprising:

drying the nonwoven fabric at about 130° C.;

fixing the pigment at about 160° C.;

fixing the leuco vat dye by subduing at about 102° C.; and removing any excess dye after oxidation.

* * * * *